US006345733B1

(12) United States Patent
Bennett

(10) Patent No.: US 6,345,733 B1
(45) Date of Patent: Feb. 12, 2002

(54) DUAL COMPARTMENT PACKAGE

(75) Inventor: Robert Alfread Bennett, Easton, CT (US)

(73) Assignee: Unilever Home & Personal Care USA, division of Conopco, Inc., Greenwich, CT (US)

( * ) Notice: Subject to any disclaimer, the term of this patent is extended or adjusted under 35 U.S.C. 154(b) by 0 days.

(21) Appl. No.: 09/566,278

(22) Filed: May 5, 2000

(51) Int. Cl.[7] ..... B65D 35/22
(52) U.S. Cl. ..... 222/94; 222/145.3
(58) Field of Search ..... 222/92, 94, 129, 222/145.1, 145.3

(56) References Cited

U.S. PATENT DOCUMENTS 3,380,632 A * 4/1968 Wilson ..... 222/94
5,318,203 A 6/1994 Iaia et al. ..... 222/94
5,645,193 A 7/1997 Gentile et al. ..... 222/137
5,927,550 A * 7/1999 Mack et al. ..... 222/94
5,954,231 A * 9/1999 Durliat et al. ..... 222/94
6,065,643 A * 5/2000 Harvey et al. ..... 222/94

* cited by examiner

*Primary Examiner*—Joseph A. Kaufman
(74) *Attorney, Agent, or Firm*—Milton L. Honig

(57) ABSTRACT

A two-compartment package is provided which includes a unitarily formed hollow sleeve with first and second openings on opposite ends. First and second compartments are formed from the sleeve through a crimp between the first and second ends, the crimp preventing fluid communication between the compartments and allowing sufficient hinged flexibility for the compartments to align parallel to one another. The cap with projections coupling together the first and second compartments maintains those compartments in parallel alignment. A variety of consumer products may be filled into the package, most particularly it is suitable for a toothpaste with mutually incompatible ingredients being separated into respective compartments, such as a peroxide and baking soda.

7 Claims, 1 Drawing Sheet

FIG. 9
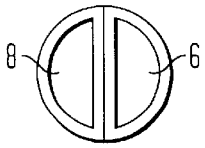
FIG. 1
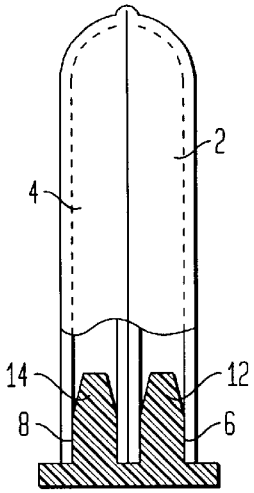
FIG. 3
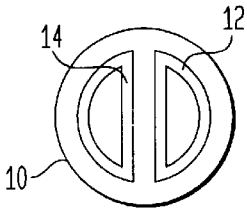
FIG. 8
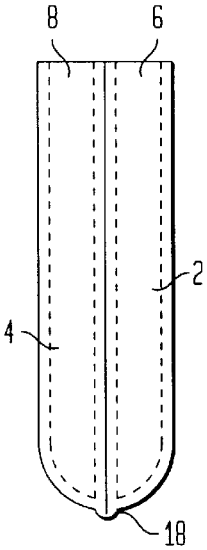
FIG. 2
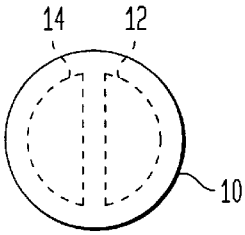
FIG. 5
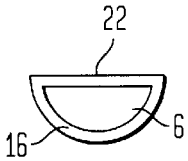
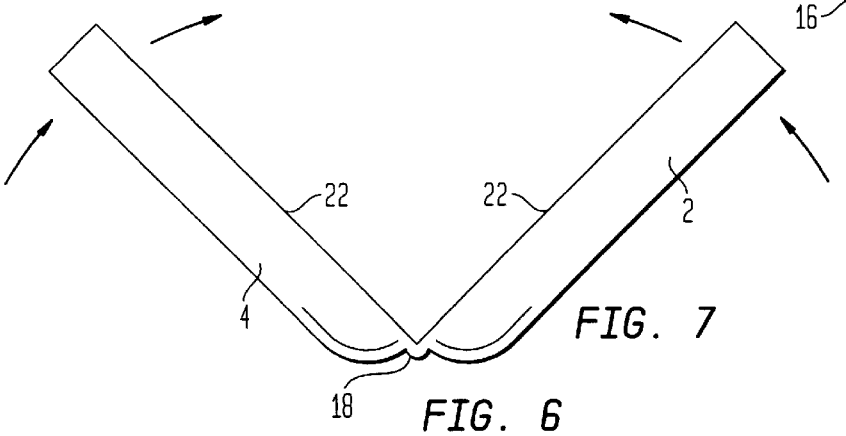
FIG. 7
FIG. 6
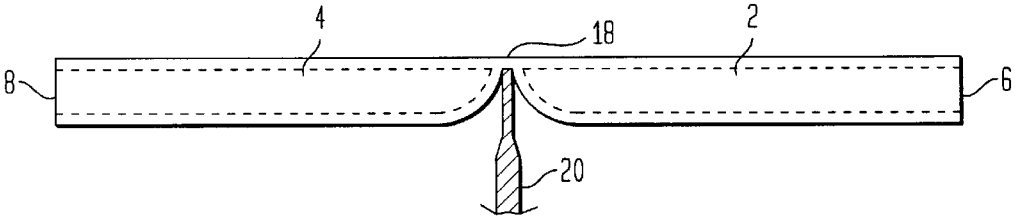
FIG. 4
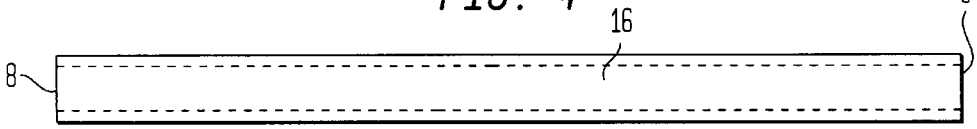

DUAL COMPARTMENT PACKAGE

BACKGROUND OF THE INVENTION

1. Field of the Invention

The invention relates to a two-compartment package for separately storing two different compositions that may be dispensed by squeezable pressure against walls of the package to simultaneously extrude the compositions.

2. The Related Art

Multi-cavity dispensing packages are useful in a variety of consumer products. These uses include the delivery of epoxy adhesives, skin treatment products, hair colorants, foods (such as condiments) and toothpastes. The latter category has been exemplified in the United States by Mentadent® toothpaste delivered from a multi-cavity dispensing pump. Baking soda and hydrogen peroxide in respective flowable carriers are stored separately in different cavities of the pump. Absent separation, these ingredients would react and decompose in storage. Only upon dispensing do the ingredients mix together for use in a consumer's mouth.

Illustrative of the general technology is U.S. Pat. No. 5,645,193 (Gentile et al.) describing a multi-cavity dispensing container including a refill cartridge and a reusable base. The cartridge contains a pair of separate parallel cylinders end-capped each with a piston head, the cylinders carrying the flowable materials. The base is constructed with a pair of separate parallel piston support posts, the combination of cartridge and base forming a a mechanical pump. This pump has been miniaturized for delivering 0.5 oz. samples. It is an expensive package.

A less costly system is described in U.S. Pat. No. 5,318,203 (Iaia et al.) based on a pair of flexibly walled side-by-side compartments. These compartments are separately formed tubes crimped together at a lower end. The tubes at their dispensing end are held together by a manifold with dispensing nozzle. Manufacture of this package is also relatively costly and cannot easily be miniaturized for sampling purposes.

While pumps and other sophisticated packaging are known, there is a need for a less expensive system, especially for sample-size purposes.

Accordingly, it is an object of the present invention to provide a two-compartment dispensing package with relatively few parts and that can be inexpensively manufactured relative to known systems.

Another object of the present invention is to provide a two-compartment dispensing package suitable for sample sizes delivering 1 oz. or less of product.

These and other objects of the present invention will more readily be understood from the following summary and detailed description.

SUMMARY OF THE INVENTION

A two-compartment package is provided which includes:

(i) a unitarily formed hollow sleeve with first and second openings on opposite ends, first and second compartments being formed through a crimp between the first and second ends, the crimp preventing fluid communication between the compartments and allowing sufficient hinged flexibility for the compartments to align parallel to one another; and (ii) a cap with projections coupling together the first and second compartments to maintain them in parallel alignment.

The sleeve may have polygonal cross section representing such shapes as round, oval, triangular, hexagonal and octagonal shapes, all of which are generally considered to be cylindrical. Particularly preferred as a cross-section will be one having a D-shape.

The projections associated with the cap are preferably two parallel plugs, each of the plugs fitting either within the respective openings or surrounding an outside perimeter of the openings. Advantageously, the plugs will be of D-shaped cross-section where each of the openings are of likewise cross-section.

A toothpaste product is also provided which includes:

(A) a two-compartment package including:

(i) a unitarily formed hollow sleeve with first and second openings on opposite ends, first and second compartments being formed through a crimp between the first and second ends, the crimp preventing fluid communication between the compartments and allowing sufficient hinged flexibility for the compartments to align parallel to one another; and (ii) a cap with projections coupling together the first and second compartments to maintain them in parallel alignment;

(B) a toothpaste including:

a first composition formulated with a peroxide in a carrier;

a second composition formulated with sodium bicarbonate in a carrier, the first and second compositions being placed in the respective first and second compartments.

BRIEF DESCRIPTION OF THE DRAWINGS

Other features, advantages and objects of the present invention will more readily be understood through consideration of the following drawing in which:

FIG. 1 is a front prospective view with partial cross-sectional detail of a two-compartment package according to the present invention;

FIG. 2 is a top plan view of a plug for use with the two-compartment package of FIG. 1;

FIG. 3 is a bottom plan view of the plug shown in FIG. 2;

FIG. 4 is a hollow sleeve representing a first step in the manufacture of two-compartment packages according to the present invention;

FIG. 5 is an end view of the sleeve shown in FIG. 4;

FIG. 6 is the hollow sleeve of FIG. 4 undergoing a second step in the manufacture of the two-compartment package;

FIG. 7 is the hollow sleeve of FIG. 6 undergoing a third step in the manufacture of the two-compartment package;

FIG. 8 is the hollow sleeve of FIG. 7 configured as a final step in the manufacture of the two-compartment package; and FIG. 9 is a top plan view of the package according to FIG. 8.

DETAILED DESCRIPTION OF THE INVENTION

A relatively inexpensive two-compartment package has been developed which can be manufactured in a relatively inexpensive manner. The package is especially useful for small sample size solids, semi-solids and liquid products. FIG. 1 illustrates the package which includes first and second compartments 2, 4. Each of the compartments has a respective first and second opening 6, 8.

A unitarily formed cap 10 is provided with a pair of projections coupling together the first and second compartments. These projections are illustrated in FIG. 1 and 3 as a pair of parallel plugs 12, 14. Alternatively, the projections instead of plugs can seal the openings by fitting around an outside perimeter of the openings in a reverse male/female coupling arrangement.

FIG. 4 through FIG. 9 detail the simple manufacturing process used to prepare the two-compartment packages. FIG. 4 illustrates a straight sleeve 16. As shown in FIG. 5, the sleeve advantageously has a D-shaped cross-section. FIG. 6 illustrates formation of a crimp 18 with a heating element 20 at a mid-point of sleeve 16. The crimp effectively divides the sleeve into respective compartments 2, 4. FIG. 7 shows the further step of bending the compartments 2, 4 at the crimp, used as a hinge, in a manner allowing the straight side 22 of the D-shaped portions of the compartment to lie adjacent one another. FIG. 8 illustrates the completed process with FIG. 9 being a top view of the resultant two-compartment package.

Different product streams can be filled within the respective compartments. Thereafter the compartments are sealed by application of the cap, the latter preventing the compartments from swinging away from each other through hinged outward movement. Advantageously the sleeve and respective compartments formed from the sleeve may be of a clear plastic. This allows consumers to see the products held within the package.

While a preferred embodiment of the present invention has been described, those skilled in the art will recognize that other changes and modifications may be made thereto without departing from the spirit and purview of this invention.

What is claimed is:

1. A two-compartment package comprising:

(i) a unitarily formed hollow sleeve with first and second openings on opposite ends, first and second compartments separated by a crimp consisting of two walls heat-sealed together between the first and second ends, the crimp preventing fluid communication between the compartments and allowing sufficient hinged flexibility for the compartments to align parallel to one another; and (ii) a cap with projections coupling together the first and second compartments to maintain them in parallel alignment.

2. The package according to claim 1 wherein the projections are two parallel plugs, the plugs each fitting within the respective first and second openings.

3. The package to claim 2 wherein the two parallel plugs each have a D-shaped cross-section.

4. The package according to claim 1 wherein the sleeve is polygonal in cross-section.

5. The package according to claim 1 wherein the sleeve is a D-shaped in cross-section.

6. The package according to claim 1 wherein the crimp is formed at a mid-point of the sleeve.

7. A toothpaste product comprising:

(A) a two-compartment package comprising:

(i) a unitarily formed hollow sleeve with first and second openings on opposite ends, first and second compartments separated by a crimp consisting of two walls heat-sealed together between the first and second ends, the crimp preventing fluid communication between the compartments and allowing sufficient hinged flexibility for the compartments to align parallel to one another; and (ii) a cap with projections coupling together the first and second compartments to maintain them in parallel alignment;

(B) a toothpaste comprising:

a first composition formulated with a peroxide in a carrier; a second composition formulated with sodium bicarbonate in a carrier, the first and second compositions being placed in the respective first and second compartments.

* * * * *